US006050659A

United States Patent [19]

LaCour

[11] Patent Number: 6,050,659

[45] Date of Patent: Apr. 18, 2000

[54] FRAME-TYPE DESK SYSTEM

[75] Inventor: Paul M. LaCour, Upper Saddle River, N.J.

[73] Assignee: LaCour Incorporated, Harrington Park, N.J.

[21] Appl. No.: 09/016,620

[22] Filed: Jan. 30, 1998

[51] Int. Cl.[7] ..... A47B 81/00

[52] U.S. Cl. ..... 312/223.3; 312/196; 108/50.01

[58] Field of Search ..... 312/223.3, 265.1, 312/265.2, 265.3, 265.4, 265.5, 265.6, 196, 195, 194; 108/50.01, 50.02, 107, 108

[56] References Cited

U.S. PATENT DOCUMENTS

| | | |
|---|---|---|
| D. 161,772 | 6/1951 | MacDonald . |
| D. 249,609 | 9/1978 | Kramer . |
| D. 251,592 | 4/1979 | Giancarlo . |
| D. 251,666 | 4/1979 | Coon . |
| D. 252,635 | 8/1979 | Richgels . |
| D. 262,763 | 1/1982 | Lerner et al. . |
| D. 275,284 | 8/1984 | Wells et al. . |
| D. 298,889 | 12/1988 | LaCour . |
| D. 298,890 | 12/1988 | LaCour . |
| D. 305,706 | 1/1990 | Mark . |
| D. 331,672 | 12/1992 | Brodbeck . |
| 1,886,766 | 11/1932 | Ulrich . |
| 2,694,614 | 11/1954 | Dent . |
| 3,197,822 | 8/1965 | Herrschaft . |
| 3,525,560 | 8/1970 | Gasner et al. . |
| 3,564,138 | 2/1971 | Harrold . |
| 3,786,765 | 1/1974 | Burr . |
| 3,870,389 | 3/1975 | Killam . |
| 3,964,401 | 6/1976 | Gutmann, Jr. et al. . |
| 4,017,134 | 4/1977 | Lenglin et al. . |
| 4,050,752 | 9/1977 | Dykstra . |
| 4,145,098 | 3/1979 | Alexander . |
| 4,313,112 | 1/1982 | Foster . |
| 4,316,082 | 2/1982 | Fritz . |
| 4,345,803 | 8/1982 | Heck . |
| 4,418,967 | 12/1983 | Winkelman, Jr. et al. . |
| 4,449,762 | 5/1984 | Turner . |
| 4,458,961 | 7/1984 | Browning . |
| 4,577,928 | 3/1986 | Brown . |
| 4,600,248 | 7/1986 | Pflieger . |
| 4,619,486 | 10/1986 | Hannah et al. . |
| 4,620,684 | 11/1986 | Delpercio et al. . |
| 4,633,324 | 12/1986 | Giulie . |
| 4,660,905 | 4/1987 | Conner et al. . |
| 4,671,481 | 6/1987 | Beard . |
| 4,755,009 | 7/1988 | Price et al. . |
| 4,766,422 | 8/1988 | Wolters et al. . |
| 4,768,845 | 9/1988 | Yeh . |
| 4,798,423 | 1/1989 | LaCour . |
| 4,836,625 | 6/1989 | Catta . |
| 4,846,078 | 7/1989 | Janson . |
| 4,863,242 | 9/1989 | Correa . |

(List continued on next page.)

FOREIGN PATENT DOCUMENTS

| | | |
|---|---|---|
| 0145410 | 6/1985 | European Pat. Off. . |
| 2183453 | 6/1987 | United Kingdom . |
| 9107118 | 5/1991 | WIPO ..... 312/194 |

OTHER PUBLICATIONS

Interior Design, "Trading Desks", pp. 1–2, feb. 1990.

*Primary Examiner*—Peter M. Cuomo
*Assistant Examiner*—Hanh V. Tran
*Attorney, Agent, or Firm*—Selitto & Associates

[57] ABSTRACT

A frame-type desk system includes a common core which has an interior raceway. More particularly, the raceway core extends longitudinally from one end of said core to an opposite end of said core and includes a plurality of independent and separate equipment bays, each of which is sized and shaped so as to receive electronic equipment therein. At least one work top extends outwardly from one side of the core so as to define at least one work station, while a supporting panel is mounted on the core and has a side which includes a mounting mechanism for mounting a plurality of accessories therefrom in a cantilevered fashion substantially above the raceway. The side of the supporting panel faces the work station such that accessories mounted therefrom extend towards the work station.

45 Claims, 7 Drawing Sheets

U.S. PATENT DOCUMENTS 4,883,330 11/1989 Armstrong et al. .
4,920,458 4/1990 Jones .
4,997,240 3/1991 Schmalzl et al. .
5,024,167 6/1991 Hayward .
5,035,470 7/1991 Miller .
5,046,791 9/1991 Kooiman .
5,071,204 12/1991 Price et al. .
5,094,174 3/1992 Grund et al. .
5,101,298 3/1992 Lentz et al. .
5,103,741 4/1992 Grund et al. .
5,130,494 7/1992 Simonton et al. .
5,174,223 12/1992 Nagy et al. .
5,183,319 2/1993 Pearson et al. .
5,220,871 6/1993 Grund et al. .
5,224,429 7/1993 Borgman et al. .
5,408,939 4/1995 Lechman .
5,423,604 6/1995 Chern .
5,499,868 3/1996 Schainholz ..... 312/236
5,513,759 5/1996 Besserer et al. .
5,609,402 3/1997 Kemp .
5,746,488 5/1998 LaCour .

FRAME-TYPE DESK SYSTEM

FIELD OF THE INVENTION

The present invention relates to a desk system, and, more particularly, to a frame-type desk system which is especially adapted to house data and communication equipment, such computer equipment.

BACKGROUND OF THE INVENTION

With the advent of microprocessor-based data distribution systems, the use of electronic voice and computerized information systems has proliferated, especially in the business sector. For instance, in the money commodity dealing field, it is common to provide trading rooms with a plurality of work stations, each station typically including a variety of data and communication equipment, such as computer keyboards, computer display screens in the form of cathode ray tubes, a telephone turret with a specified number of direct lines and telephone line monitoring units and other peripheral devices. To ensure optimum interaction between traders during trading periods and/or to make maximum unitization of space, the work stations are oftentimes ganged together to form a cluster of work stations. Such clusters can be formed by arranging several double work stations (i.e., two work stations arranged in back-to-back or tandem fashion) side-by-side, the resulting cluster comprising two rows of back-to-back work stations.

In providing work stations in trading rooms, there are several special considerations that need to be addressed. One consideration relates to the provision of clear sight lines over work stations for various purposes (e.g. promoting efficient communication between traders in the trading room). Another consideration relates to the provision of work stations adapted for quick and efficient assembly, disassembly and reconfiguration due to the advent of 24 hour global trading practices and the consequences resulting therefrom (e.g., the need to complete services, removal, upgrade and/or reconfiguration of work stations within the limited time period of off-hours). In addition, because of the proliferation of the local area network and desk top computer technology, there are numerous user-preferred combinations of computer-related equipment varying from work station to work station. As a result, the work stations need to be adapted for adjustability and retrofittability in accordance with user preference.

Computer work stations have been developed in the past (see, for instance, U.S. Pat. Nos. Des. 251,666; Des. 275, 284; U.S. Pat. Nos. 4,316,082; 4,345,803 and 4,449,762). While some of these work stations have a modular construction (see, for instance, U.S. Pat. Nos. 4,313,112 and 4,458, 961) and others are adapted to be ganged together (see, for instance, U.S. Pat. No. Des. 251,592), they are not specifically designed to be arranged in back-to-back or side-by-side fashion due to their absence of a common, unobstructed raceway core and/or double faced center spline slat wall partition. Thus, these work stations are not especially suitable for the formation of clusters which comprise two rows of work stations arranged back-to-back. As a result, such clusters have in the past been formed by arranging conventional desks in back-to-back fashion (see, for instance, U.S. Pat. Nos. 1,886,766 and 2,694,614).

One problem encountered when gaging together the conventional desks or computer work stations described above involves providing adequate room for and access to the necessary telephone, data and electrical service lines and accessory equipment. Without adequate room for technicians to gain access to such service lines and accessory equipment, field installation and maintenance can be made difficult.

U.S. Pat. Nos. 4,619,486 and 4,883,330 disclose a spine assembly adapted to support a pair of desk tops in back-to-back fashion. A plurality of spine assemblies may be joined end-to-end to create an interconnected network of desk assemblies. While each spine assembly is adapted to house utility and communication lines, no provision is made to mount electronic equipment, such as computer control processing units and monitors, from or in the spine assembly.

Frame-type desks have also been developed (see, for instance, U.S. Pat. No. 5,609,402). However, these frame-type desks lack adjustability and retrofittability.

The desk system disclosed in LaCour '423 patent has been a commercial success since its introduction to the marketplace. The desk system continues to have utility in installations where user needs and requirements are unlikely to change significantly during the lifetime of the desk system.

Applicant's copending application Ser. No. 08/542,170 filed Oct. 12, 1995 and application Ser. No. 08/939,176 filed Sep. 29, 1997, the specifications of which are incorporated herein by reference, disclose a desk system adapted for field adjustability and retrofittability. More particularly, the desk system has a raceway core, a pair of work tops, which extend outwardly from opposing sides of the raceway core, and a slat wall structure suspended above the raceway core between the work tops. The raceway includes a raceway sized and shaped to receive data and communication equipment therein, while the slat wall structure has slats on each side thereof for supporting platforms therefrom. While this desk system addresses the various considerations and/or problems mentioned above, it does so without compartmentalizing its raceway into compartments or equipment bays.

SUMMARY OF THE INVENTION

The present invention overcomes the disadvantages and shortcomings of the prior art discussed above by providing a new and improved frame-type desk system including a common core which has an interior raceway. More particularly, the raceway core extends longitudinally from one end of said core to an opposite end of said core and includes a plurality of independent and separate equipment bays, each of which is sized and shaped so as to receive electronic equipment therein. At least one work top extends outwardly from one side of the core so as to define at least one work station, while a supporting panel is mounted on the core and has a side which includes a mounting mechanism for mounting a plurality of accessories therefrom in a cantilevered fashion substantially above the raceway. The side of the supporting panel faces the work station such that accessories mounted therefrom extend towards the work station.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENT

Although the present invention is applicable to many different types of data and communication desk systems, it is especially suitable for use in connection with money market and commodity dealing desk systems. Accordingly, the present invention will be described in connection with such a dealing desk system. It should be understood, however, that the following description is only meant to be illustrative of the present invention and is not meant to limit the scope of the present invention, which has applicability to other types of desk systems.

Figure 1:
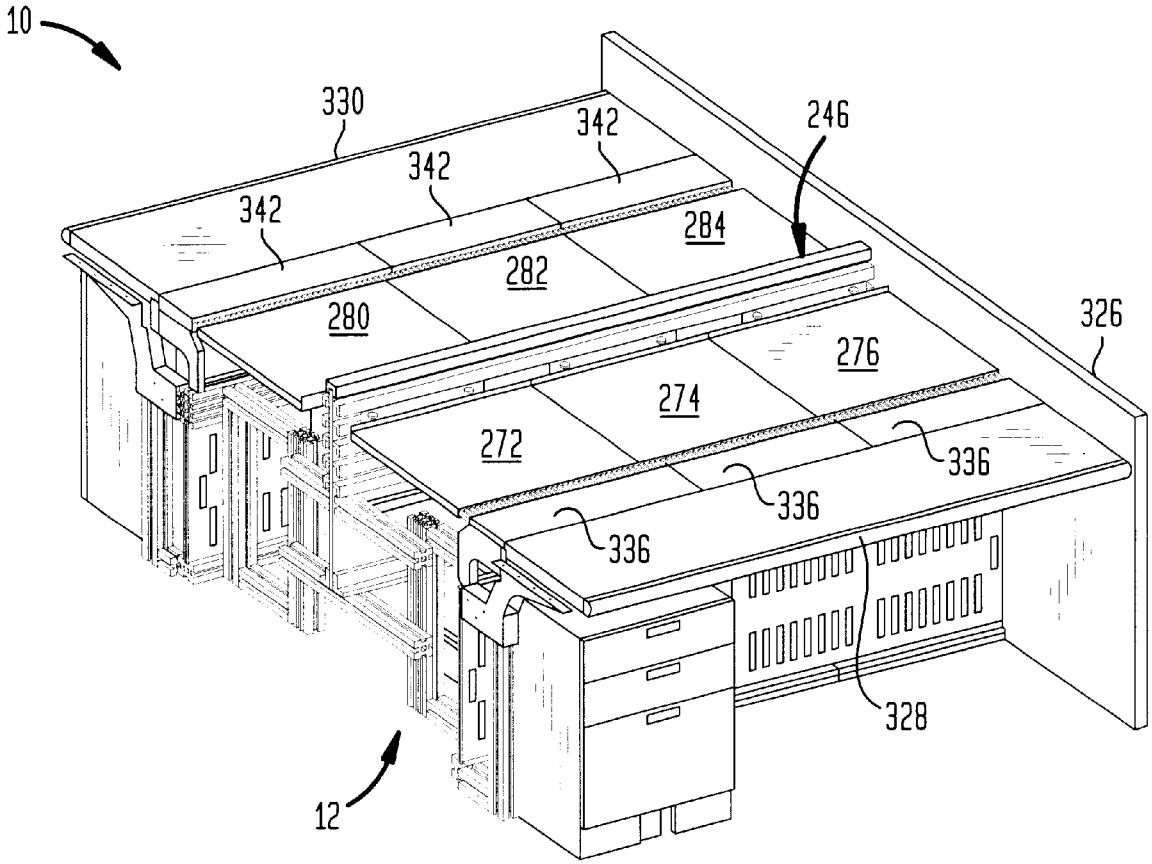
FIG. 1 is a perspective view of a frame-type desk system constructed in accordance with the present invention.
Figure 2:
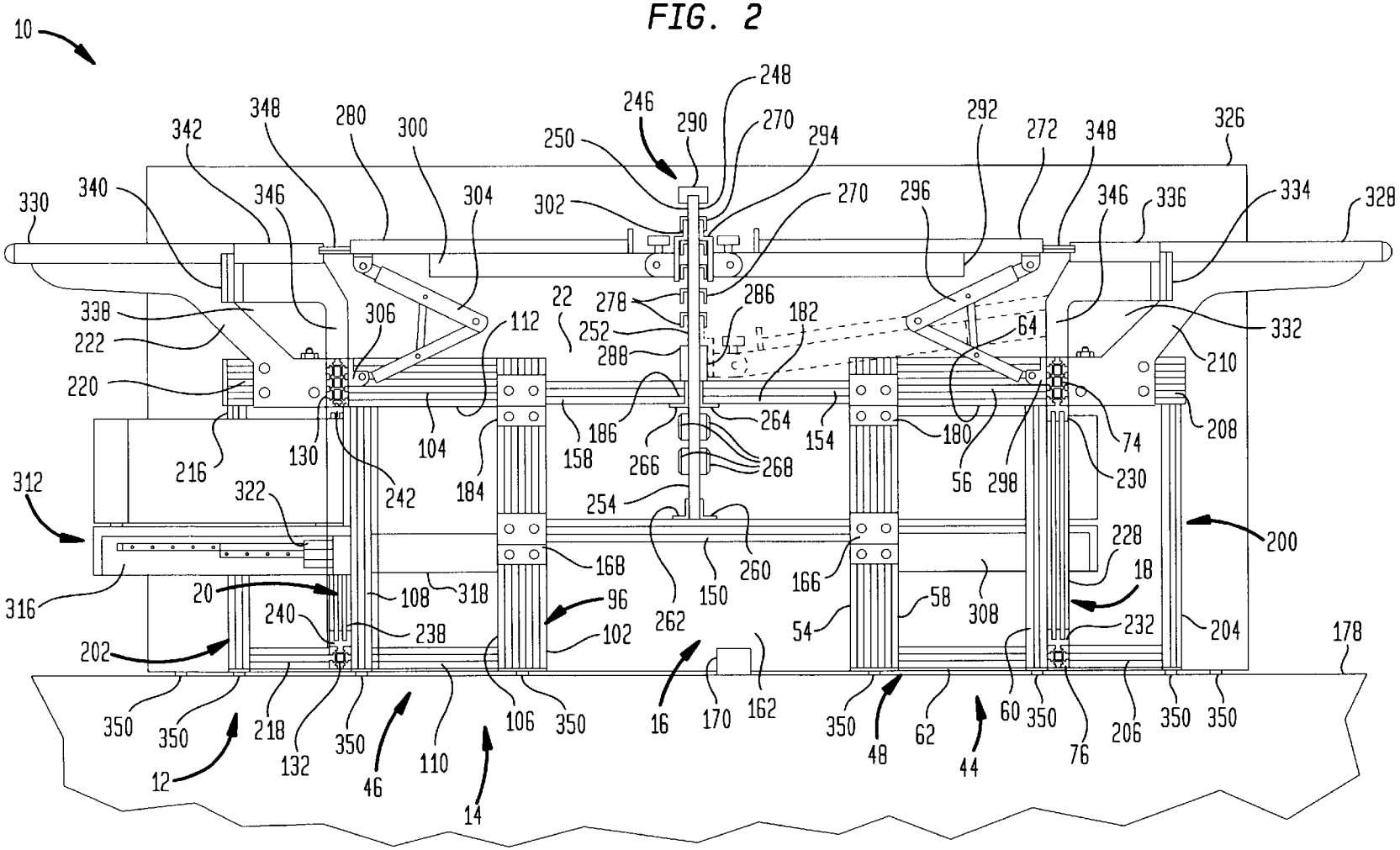
FIG. 2 is a side elevational view of the desk system shown in FIG. 1.
Figure 3:
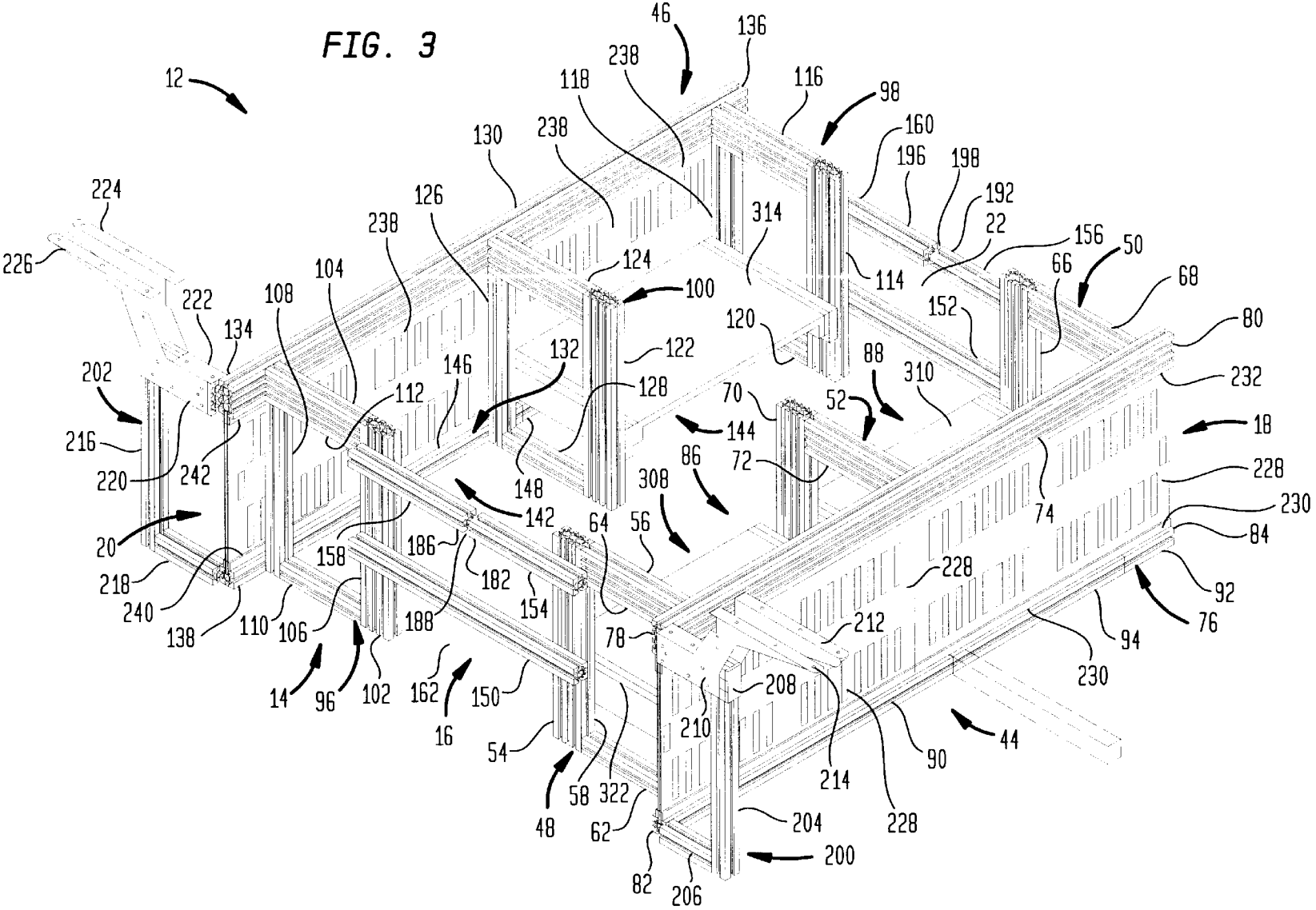
FIG. 3 is a perspective view of a frame assembly utilized in the desk system shown in FIGS. 1 and 2.

FIG. 1 shows a frame-type dealing desk system 10 having a double (i.e., back-to-back) work station construction. Referring primarily to FIGS. 2 and 3, the desk system 10 includes a frame assembly 12 defining a freestanding common raceway core 14 for the desk system 10. The raceway core 14 has a substantially unobstructed raceway 16 extending between opposing sides 18, 20 of the raceway core 14. The raceway 16 is large enough to create a crawlspace and to otherwise accommodate telephone, data and electrical service lines, electronic equipment (e.g., central processing units), patch panels, power and data termination demarcation or the like. In addition, the raceway core 14 has a substantially open top 22 such that the raceway 16 and therefore equipment housed therein are easily accessible from above through the open top 22.

Figure 5:
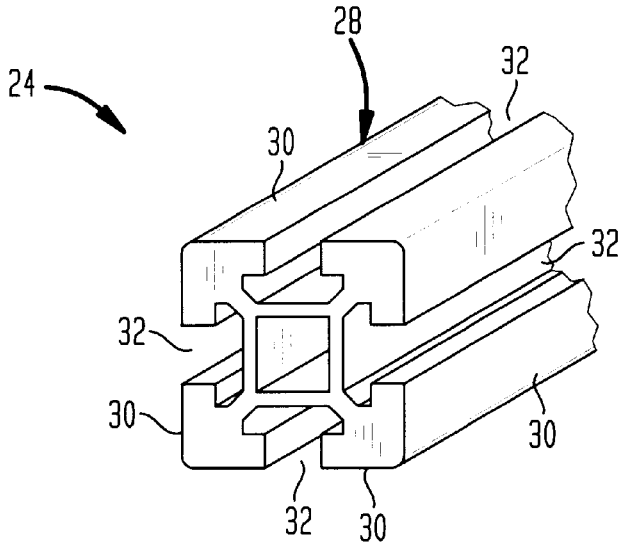
FIG. 5 is a perspective view of a section of an extrusion member which is similar to narrow extrusion members utilized in the frame assembly shown in FIGS. 3 and 4.
Figure 6:
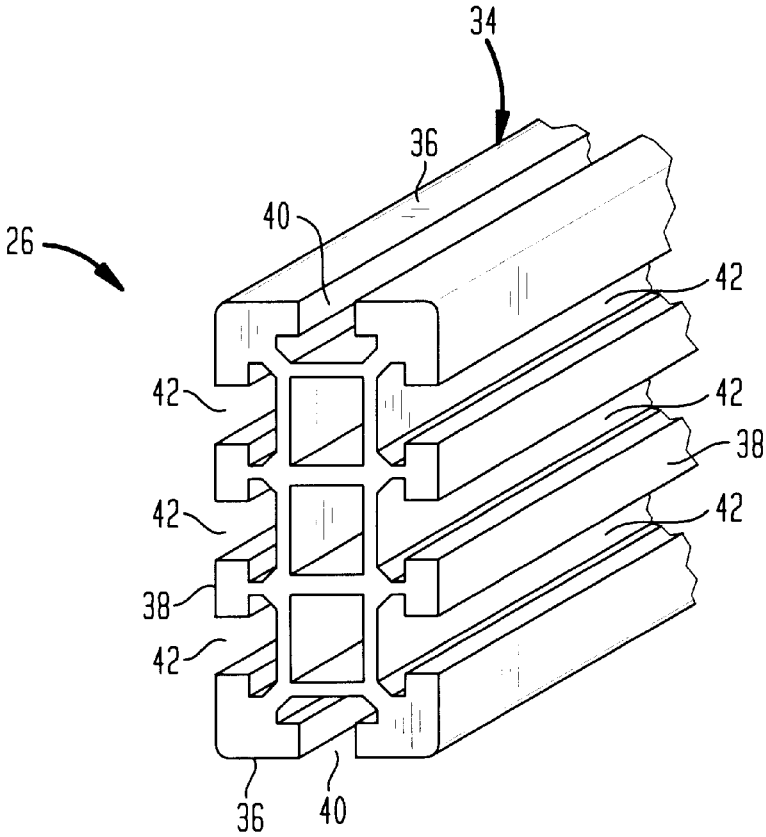
FIG. 6 is a perspective view of a section of an extrusion member which is similar to wide extrusion members utilized in the frame assembly shown in FIGS. 3 and 4.

With reference to FIG. 3, the frame assembly 12 is constructed substantially entirely from conventional extrusion members, the construction of which is similar to either that of a narrow extrusion member 24 shown in FIG. 5 or that of a wide extrusion member 26 shown in FIG. 6. Referring to FIG. 5, the narrow extrusion member 24 has an elongated body 28 made from a conventional material, such as aluminum, and provided with a plurality of sides 30 having sizes and shapes substantially identical to one another. Each of the sides 30 includes a groove 32 therein along the entire longitudinal length of the narrow extrusion member 24.

Referring to FIG. 6, the wide extrusion member 26 has an elongated body 34 made from a conventional material, such as aluminum, and provided with a pair of opposing narrow sides 36 and a pair of wide opposing sides 38. Each of the narrow sides 36 includes a groove 40 formed therein along the entire longitudinal length of the wide extrusion member 26. Similarly, each of the wide sides 38 includes a plurality of grooves 42 formed therein along the entire longitudinal length of the wide extrusion member 26.

To facilitate consideration and discussion, it should be noted that each of the extrusion members utilized in the frame assembly 12 of the desk system 10 is removably connected to its associated extrusion members, as well as its associated non-extrusion components, in a conventional manner using conventional connectors (not shown). In such circumstances, the specific manner of connecting the extrusion members of the frame assembly 12 to one another and/or to their associated non-extrusion components is not being described herein.

Figure 4:
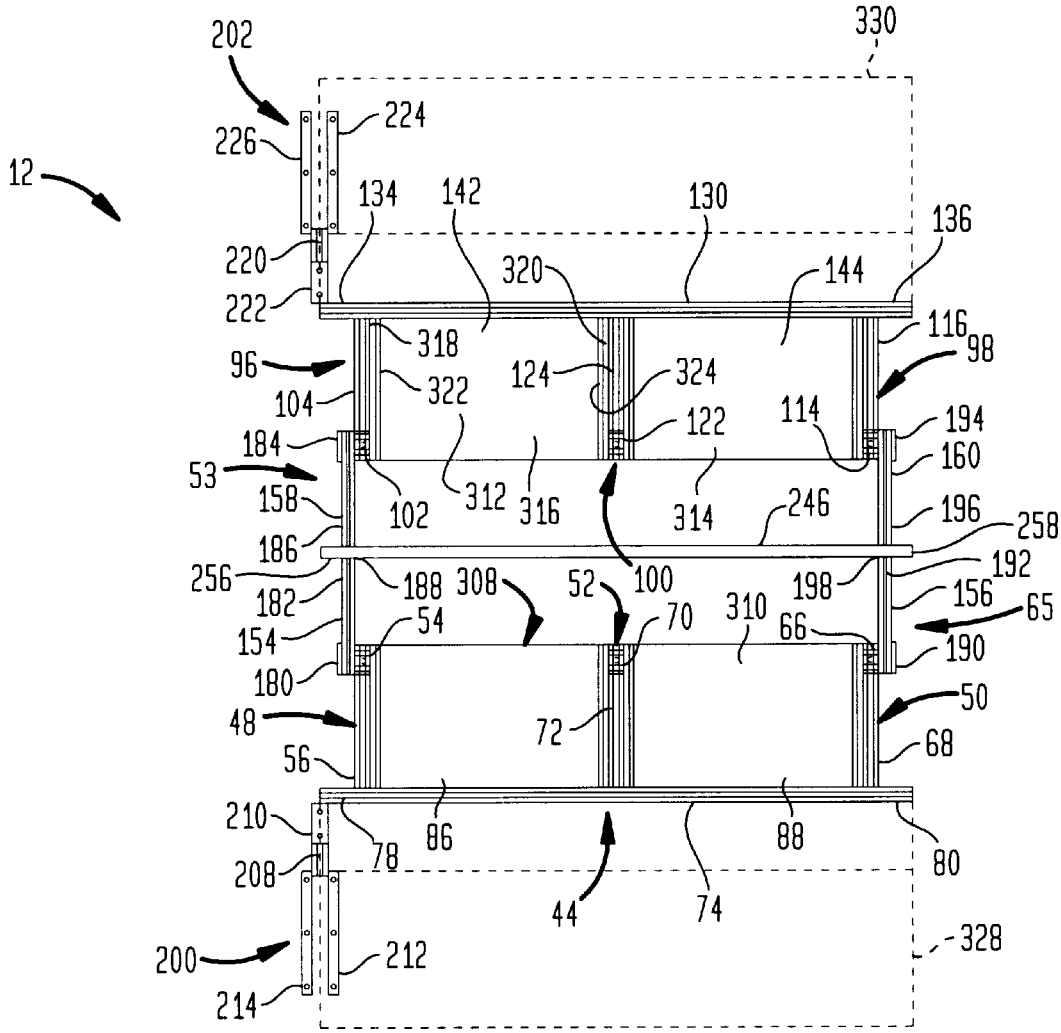
FIG. 4 is a top plan view of the frame assembly shown in FIG. 3.

With reference to FIGS. 2–4, the frame assembly 12 includes a pair of stanchion/raceway fascia subassemblies 44, 46 (referred to hereinafter as "the stanchion subassemblies"). More particularly, the stanchion subassembly 44 includes a pair of outer stanchions 48, 50 and an inner stanchion 52 (see FIGS. 3 and 4), all of which are arranged along the side 18 of the raceway core 14. The outer stanchion 48, which has a rectangular shape and which is positioned adjacent an end 53 (see FIG. 4) of the raceway core 14, is provided with a distal vertical extrusion member 54 and an upper horizontal extrusion member 56, both of which are similar to the wide extrusion member 26 of FIG. 6 in construction. More particularly, the upper horizontal extrusion member 56 is connected to a proximal narrow side 58 of the distal vertical member 54 at an upper end of same. The outer stanchion 48 is also provided with a proximal vertical member 60 (see FIG. 2) and a lower horizontal member 62, both of which are similar to the narrow extrusion member 24 of FIG. 5 in construction. The proximal vertical member 60 depends from a lower narrow side 64 of the upper horizontal member 56, while the lower horizontal member 62 extends between the distal and proximal vertical members 54, 60 along a lower end of the outer stanchion 48.

Referring to FIG. 3, the outer stanchion 50 and the inner stanchion 52 are identical to the outer stanchion 48 in construction. As a result, the outer stanchion 50, which is positioned adjacent an end 65 (see FIG. 4) of the raceway core 14, includes a distal vertical extrusion member 66, an upper horizontal extrusion member 68, a proximal vertical extrusion member (not shown) and a lower horizontal extrusion member (not shown). Similarly, the inner stanchion 52 includes a distal vertical extrusion member 70, an upper horizontal extrusion member 72, a proximal vertical extrusion member (not shown) and a lower horizontal extrusion member (not shown).

Referring generally to FIGS. 2 and 4 and specifically to FIG. 3, the stanchion subassembly 44 also includes a header extrusion member 74 and a sill extrusion member 76, which extend continuously from the end 53 (see FIG. 4) of the raceway core 14 to the end 65 (see FIG. 4) of same along the side 18 and which are connected to the outer stanchions 48, 50 and the inner stanchion 52. More particularly, the header member 74, which has a construction similar to that of the wide extrusion member 26 shown in FIG. 6, is attached to proximal ends of the upper horizontal members 56, 68, 72 of the outer and inner stanchions 48, 50, 52, respectively. The sill member 76, which has a construction similar to that of the narrow extrusion member 24 shown in FIG. 5, is attached to a lower end of the proximal vertical member 60 of the outer stanchion 48 and to lower ends of the proximal vertical members of the outer and inner stanchions 50, 52. The header member 74 has free ends 78, 80, while the sill member 76 has free ends 82, 84. The outer stanchions 48, 50 are spaced inwardly from the free ends 78 , 80, respectively, of the header member 74 and from the free ends 82, 84, respectively, of the sill member 76. The inner stanchion 52 is positioned between the outer stanchions 48, 50 so as to cooperate with the outer stanchions 48, 50 to form a pair of separate and independent equipment bays or compartments 86, 88 (see FIGS. 3 and 4) arranged in a side-by-side manner along the side 18 of the raceway core 14 for purposes to be discussed hereinbelow. Because the distance between the inner stanchion 52 and the outer stanchion 48 is substantially identical to the distance between the inner stanchion 52 and the outer stanchion 50, the size and shape of the equipment bay 86 is substantially identical to those of the equipment bay 88.

With reference to FIG. 3, the sill member 76 has a long stationary section 90, a short stationary 92 and a movable section 94 which is pivotally connected to the long stationary section 90 by a conventional hinge mechanism (not shown). As a result, the movable section 94, which is aligned with the equipment bay 88, is pivotable relative to the long stationary section 90 between a closed position, in which it is in alignment with the long and short stationary sections 90, 92 (as indicated by the solid line representation of the movable section 94 in FIG. 3), and an open position, in which it is swung outwardly away from the short stationary section 92 (as indicated by the broken line representation of the movable section 94 in FIG. 3).

Referring generally to FIGS. 2 and 4 and specifically to FIG. 3, the stanchion subassembly 46, which is substantially identical to the stanchion subassembly 44 in construction, includes a pair of outer stanchions 96, 98 and an inner stanchion 100, all of which are arranged along the side 20 of the raceway core 14. The outer stanchion 96, which has a rectangular shape and which is positioned adjacent the end 53 (see FIG. 4) of the raceway core 14, is provided with a distal vertical extrusion member 102 and an upper horizontal extrusion member 104, both of which are similar to the wide extrusion member 26 of FIG. 6 in construction. More particularly, the upper horizontal extrusion member 104 is connected to a proximal narrow side 106 of the distal vertical member 102 at an upper end of same. The outer stanchion 96 is also provided with a proximal vertical member 108 and a lower horizontal member 110, both of which are similar to the narrow extrusion member 24 of FIG. 5 in construction. The proximal vertical member 108 depends from a lower narrow side 112 of the upper horizontal member 104, while the lower horizontal member 110 extends between the distal and proximal vertical members 102, 108 along a lower end of the outer stanchion 96.

Referring to FIG. 3, the outer stanchion 98 and the inner stanchion 100 are identical to the outer stanchion 96 in construction. As a result, the outer stanchion 98, which is positioned adjacent the end 65 (see FIG. 4) of the raceway core 14, includes a distal vertical extrusion member 114, an upper horizontal extrusion member 116, a proximal vertical extrusion member 118 and a lower horizontal extrusion member 120. Similarly, the inner stanchion 100 includes a distal vertical extrusion member 122, an upper horizontal extrusion member 124, a proximal vertical extrusion member 126 and a lower horizontal extrusion member 128.

Still referring to FIG. 3, the stanchion subassembly 46 also includes a header extrusion member 130 and a sill extrusion member 132, which extend continuously from the end 53 (see FIG. 4) of the raceway core 14 to the end 65 (see FIG. 4) of same along the side 20 and which are connected to the outer stanchions 96, 98 and the inner stanchion 100. More particularly, the header member 130, which has a construction similar to that of the wide extrusion member 26 shown in FIG. 6, is attached to proximal ends of the upper horizontal members 104, 116, 124 of the outer and inner stanchions 96, 98, 100, respectively. The sill member 132, which has a construction similar to that of the narrow extrusion member 24 shown in FIG. 5, is attached to lower ends of the proximal vertical members 108, 118, 126 of the outer and inner stanchions 96, 98, 100, respectively. The header member 130 has free ends 134, 136, while the sill member 132 has free ends 138 (only one of which is shown in FIG. 3). The outer stanchions 96, 98 are spaced inwardly from the free ends 134, 136, respectively, of the header member 130 and from the free ends 138 of the sill member 132 (see also FIG. 4). The inner stanchion 100 is positioned between the outer stanchions 96, 98 so as to cooperate with the outer stanchions 96, 98 to form a pair of separate and independent equipment bays 142, 144 (see FIGS. 3 and 4) arranged in a side-by-side manner along the side 20 of the raceway core 14 for purposes to be discussed hereinbelow. Because the distance between the inner stanchion 100 and the outer stanchion 96 is substantially identical to the distance between the inner stanchion 100 and the outer stanchion 98, the size and shape of the equipment bay 142 is substantially identical to those of the equipment bay 144.

Like the sill member 76 of the stanchion subassembly 44, the sill member 132 of the stanchion subassembly 46 has a long stationary section 146, a short stationary (not shown) and a movable section 148 (only a portion of which is shown in FIG. 3) pivotally connected to the long stationary section 146 by a conventional hinge mechanism (not shown). As a result, the movable section 148, which is aligned with the equipment bay 144, is pivotable relative to the long stationary section 146 between a closed position, in which it is in alignment with the long stationary section 146 and the short stationary section, and an open position, in which it is swung outwardly away from the short stationary section.

With reference to FIGS. 2–4, the frame assembly 12 is provided with a pair of lower strut extrusion members 150, 152, both of which are similar to the narrow extrusion member 24 of FIG. 5 in construction, and upper strut members 154, 156, 158, 160, all of which are similar to the narrow extrusion member 24 of FIG. 5, to connect the stanchion subassembly 44 to the stanchion subassembly 46, thereby forming the raceway core 14. More particularly, the lower strut members 150, 152 and the upper strut members 154, 156, 158, 160 connect the stanchion subassemblies 44, 46 to each other in a spaced manner so as to form a raceway channel 162 (see FIGS. 2 and 3) in the raceway 16 between the stanchion subassemblies 44, 46 for accommodating electrical, data and/or communication cables or the like.

The lower strut member 150, which extends along the end 53 (see FIG. 4) of the raceway core 14, is removably attached to outer wide sides (i.e., those sides facing away from the outer stanchions 50, 98) of the distal vertical members 54, 102 of the outer stanchions 48, 96, respectively, by brackets 166, 168 (shown in FIG. 2 but not shown in FIG. 3), respectively. Likewise, the lower strut member 152, which extends along the end 65 (see FIG. 4) of the raceway core 14, is removably attached to outer wide sides (i.e., those sides facing away from the outer stanchions 48, 96) of the distal vertical members 66, 114 of the outer stanchions 50, 98, respectively, by brackets (not shown). As shown in FIGS. 2 and 3, the lower strut members 150, 152 are mounted to the distal vertical members 54, 102 and to the distal vertical members 66, 114, respectively, above lower ends of same (i.e., above a bottom of the raceway core 14) and are therefore suspension-mounted (i.e., suspended above a floor 178 (see FIG. 2) supporting the desk system 10). In this manner, the lower strut members 150, 152 are adapted to accommodate floor-mounted or floor-supported equipment, electrical outlets, cable access ports, electrical, data or communication cables 170 or the like (see FIG. 2). In other words, electrical, data or communication cables can be fed to electronic equipment supported in or on the desk system 10 through a lower portion of the raceway channel 162 (i.e., the portion of the raceway channel 162 located below the lower struts 150, 152).

Referring to FIG. 2–4, the upper strut member 154 has an end connected to the outer wide side of the distal vertical member 54 of the outer stanchion 48 by a bracket 180 (shown in FIGS. 2 and 4 but not shown in FIG. 3). The upper strut member 154 extends from the distal vertical member 54 towards the outer stanchion 96 of the stanchion subassembly 46 along the end 53 (see FIG. 4) of the raceway core 14 and terminates at a free end 182 thereof. Likewise, the upper strut member 158 has an end connected to the outer wide side of the distal vertical member 102 of the outer stanchion 96 by a bracket 184 (shown in FIGS. 2 and 4 but not shown in FIG. 3). The upper strut member 158 extends from the distal vertical member 102 towards the outer stanchion 48 of the stanchion subassembly 44 along the end 53 (see FIG. 4) of the raceway core 14 and terminates at a free end 186 thereof. The free ends 182, 186 of the upper strut members 154, 158, respectively, abut each other but are spaced from one another so as to form a gap 188 therebetween for purposes to be discussed hereinafter.

With reference to FIGS. 3 and 4, the upper strut member 156 has an end connected to the outer wide side of the distal vertical member 66 of the outer stanchion 50 by a bracket 190. The upper strut member 156 extends from the distal vertical member 66 towards the outer stanchion 98 of the stanchion subassembly 46 along the end 65 (see FIG. 4) of the raceway core 14 and terminates at a free end 192 thereof. Likewise, the upper strut member 160 has an end connected to the outer wide side of the distal vertical member 114 of the outer stanchion 98 by a bracket 194. The upper strut member 160 extends from the distal vertical member 114 towards the outer stanchion 50 of the stanchion subassembly 44, along the end 65 (see FIG. 4) of the raceway core 14 and terminates at a free end 196 thereof. The free ends 192, 196 of the upper strut members 156, 160, respectively, abut each other but are spaced from one another so as to form a gap 198 therebetween for purposes to be discussed hereinafter.

Referring back to FIGS. 2–4, the frame assembly 12 is also provided with a pair of C-shaped support subassemblies 200, 202 extending outwardly from the stanchion subassemblies 44, 46, respectively. More particularly, the support subassembly 200 includes a leg extrusion member 204, which is similar to the narrow extrusion member 24 of FIG. 5 in construction. A lower connecting extrusion member 206, which is similar to the narrow extrusion member 24 of FIG. 5 in construction, connects an adjacent side of the leg member 204 to the free end 82 of the sill member 76 of the stanchion subassembly 44. An upper connecting extrusion member 208, which is similar to the wide extrusion member 26 of FIG. 6 in construction, also connects the adjacent side of the leg member 204 to the free end 78 of the header member 74. The support subassembly 200 also includes a support arm 210 supported on the upper connecting member 208 and having a pair of ledges 212, 214. As shown in FIG. 4, the support subassembly 200 outwardly overhangs the free ends 78, 82 of the header and sill members 74, 76, respectively, for purposes to be discussed hereinafter.

Like the support subassembly 200, the support subassembly 202 includes a leg extrusion member 216, which is similar to the narrow extrusion member 24 of FIG. in construction. A lower connecting extrusion member 218, which is similar to the narrow extrusion member 24 of FIG. 5 in construction, connects an adjacent side of the leg member 216 to the free end 138 of the sill member 132 of the stanchion subassembly 46. An upper connecting extrusion member 220, which is similar to the wide extrusion member 26 of FIG. 6 in construction, also connects the adjacent side of the leg member 216 to the free end 134 of the header member 130. The support subassembly 202 also includes a support arm 222 supported on the upper connecting member 220 and having a pair of ledges 224, 226. As shown in FIG. 4, the support subassembly 202 outwardly overhangs the free ends 134, 138 of the header and sill members 130, 132, respectively, for purposes to be discussed hereinafter.

Figure 9:
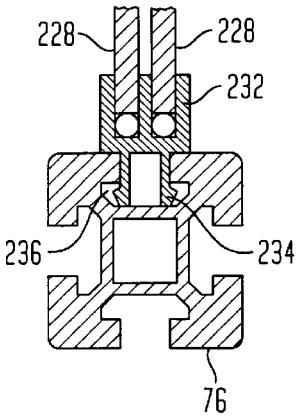
FIG. 9 is a cross-sectional view of a sill extrusion member utilized in the frame assembly shown in FIGS. 3 and 4 and equipped with a rail for sliding doors.

Referring to FIGS. 2 and 3, the desk system 10 also includes sliding doors 228 mounted between the header and sill members 74, 76 of the stanchion subassembly 44 and cooperating with same to delimit the side 18 of the raceway core 14. For mounting the doors 228 on the stanchion subassembly 44, rails 230, 232 are removably attached to the header and sill members 74, 76, respectively. More particularly, with reference to FIG. 9, the rail 232 has a tongue 234 sized and shaped so as to be snap-fitted into a groove 236 formed in an associated side of the sill member 76 of the stanchion subassembly 44. Likewise, the rail 230 has a tongue (not shown) sized and shaped so as to be snap-fitted into a groove (not shown) formed in an associated side of the header member 74 of the stanchion subassembly 44.

Sliding doors 238 are also mounted between the header and sill members 130, 132 of the stanchion subassembly 46 and cooperate with same to delimit the side 20 of the raceway core 14 (see FIGS. 2 and 3). For mounting the doors 238 on the stanchion subassembly 46, rails 240, 242 (see FIGS. 2 and 3) are removably attached to the header and sill members 130, 132 in a manner similar to those described above in connection with the rails 230, 232, respectively.

With reference to FIGS. 1, 2 and 4, the desk system 10 is provided with a slat wall panel 246 similar to the slat wall structures disclosed in applicant's above-mention applications. The slat wall panel 246 has a planar construction and is removably supported on the frame assembly 12 in such a manner that the raceway 16 is substantially unobstructed. More particularly, the slat wall panel 246, which has a pair of opposing sides 248, 250, is supported between the stanchion subassemblies 44, 46 and spans the raceway 16 from the end 53 (see FIG. 4) of the raceway core 14 to the end 65 (see FIG. 4) of same. The slat wall panel 246 includes an upper section 252 and a lower section 254 (see FIG. 2) which has a pair of opposing end portions 256, 258 (see FIG. 4) positioned in the gaps 188, 198, respectively, formed between the upper strut members 154, 158 and between the upper strut members 156, 160, respectively. More particularly, the lower section 254 rests on the lower strut members 150, 152 of the frame assembly 12 and is therefore sunk into the raceway 16 in a suspended manner above the floor 178. That is, the lower section 254 is positioned in an upper portion of the raceway channel 162 of the raceway 16 (i.e., the portion of the raceway channel 162 located above the lower strut members 150, 152). The lower section 254 is also provided with a pair of lower L-shaped brackets 260, 262 (see FIG. 2) mounted on the sides 248, 250, respectively, of the slat wall panel 246 for securing the slat wall panel 246 to the lower strut members 150, 152. Upper L-shaped brackets 264, 266 (see FIG. 2) are mounted on the sides 248, 250, respectively, of the slat wall panel 246 so as to secure the slat wall panel 246 to the upper strut members 154, 156 and to the upper strut members 158, 160, respectively. That is, the upper bracket 264 removably attaches the end portions 256, 258 of the slat wall panel 246 to the free ends 182, 192 of the upper strut members 154, 156, respectively, while the upper bracket 266 removably attaches the end portions 256, 258 to the free ends 186, 196 of the upper strut members 158, 160, respectively. In this manner, the upper brackets 264, 266 cooperate with the lower brackets 260, 262 in maintaining the slat wall panel 246 in an upright manner. Strips of electrical outlets 268 are also mounted to the lower section 254 on each of the sides 248, 250 of the slat wall panel 246 for providing electricity to electronic or electrical equipment mounted on the desk system 10.

Referring to FIG. 2, the upper section 252 of the slat wall panel 246 extends above the raceway 16 and includes a vertically arranged array of downwardly projecting L-shaped slats 270, which are mounted to the side 248 of the slat wall panel 246 for supporting slat wall accessories, such as tiltable platforms 272, 274, 276 (see FIG. 1), therefrom above the raceway 16 in a cantilevered fashion, and a vertically arranged array of downwardly projecting L-shaped slats 278 which are mounted to the side 250 of the slat wall panel 246 for supporting slat wall accessories, such as tiltable platforms 280, 282, 284 (see FIG. 1), therefrom above the raceway 16 in a cantilevered fashion. The upper section 252 also includes support plates 286, 288 attached to the sides 248, 250, respectively, of the slat wall panel 246 adjacent a lower end of the upper section 252, as well as an upper cap 290 at an upper end thereof.

Figure 7:
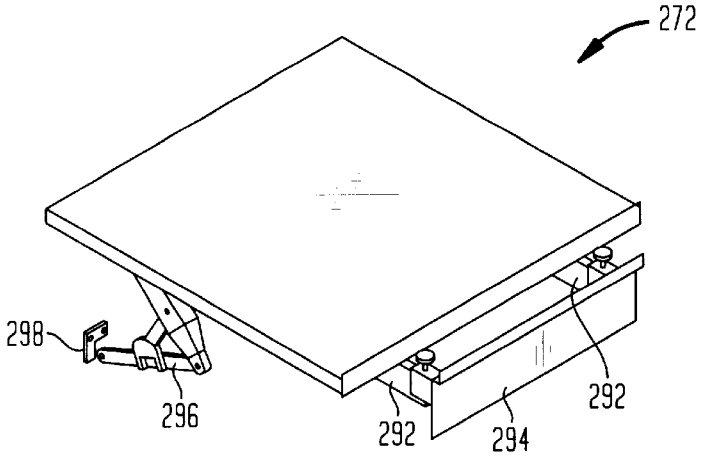
FIG. 7 is a perspective view of a platform utilized in the desk system shown in FIGS. 1 and 2.

With reference to FIGS. 2 and 7, the platform 272, which is similar to the platforms disclosed in applicant's above-mentioned applications, is adapted to support computer monitors (not shown) and/or any other accessories of the desk system 10, such as a shelf unit (not shown). More particularly, the platform 272 is equipped with horizontal support members 292 to which a Z-shaped flange 294 is attached. The Z-shaped flange 294 is adapted to be interconnected with and disconnected from a selected one of the slats 270 such that the vertical position of the platform 272 can be adjusted (i.e., raised or lowered) by the installer or by the user. For instance, at the lowest position of the platform 272 (as indicated by the broken line representation of the platform 272 in FIG. 2), the flange 294 is interconnected to the lowest slat 270 and is engaged by the support plate 286 which functions to maintain the engagement between the Z-shaped flange 294 and the lowest slat 270. The platform 272 is also movable along the length of the slats 270 (i.e., towards and away from the end portions 256, 258 of the slat wall panel 246). In such circumstances, because the platform 272 is vertically and horizontally adjustable, its position can be selectively varied to suit changing work environment, user preferences, etc. In this regard, the Z-shaped flange 294 is pivotally connected to the support members 292 so that the orientation of the platform 272 relative to the horizontal can be varied to further accommodate the ergonomic preferences of the user. The platform 274 also includes vertical support members (i.e., scissors ratchets) 296 which depend therefrom and which have feet 298 adapted to be mounted to the header member 74 of the stanchion subassembly 44. The vertical support members 296 articulate to facilitate the adjustment of the angular orientation of the platform 272. That is, when the angular orientation of the platform 272 has been established, the vertical support members 296 function to provide support for the platform 272.

The remaining platforms 274, 276, 280, 282, 284 are identical to the platform 272 in construction and operation. For instance, the platform 280 is equipped with horizontal support members 300 (only one of which is shown in FIG. 2) to which a Z-shaped flange 302 is attached. The Z-shaped flange 302 is adapted to be interconnected with and disconnected from a selected one of the slats 278. The platform 280 also includes vertical support members 304 (only one of which is shown in FIG. 2) which depend therefrom and which have feet 306 (only one of which is shown in FIG. 2) adapted to be mounted to the header member 130 of the stanchion subassembly 46.

Referring to FIGS. 3 and 4, the desk system 10 is also provided with sliding tray subassemblies 308, 310, 312, 314 which are mounted in the equipment bays 86, 88, 142, 144, respectively, formed in the raceway 16. With additional reference to FIG. 2, the tray subassembly 312 (not shown in FIG. 3) includes a tray 316 which is sized and shaped so as to support electrical or electronic equipment, such as a central processing unit (CPU) of a computer, housed in the raceway 16. Connecting plates 318, 320 (see FIGS. 2 and 4) are positioned at opposite ends of the tray 316 and are mounted directly to the distal and proximal vertical members 102, 108 of the outer stanchion 96 and to the distal and proximal vertical members 122, 126 of the inner stanchion 100, respectively. More particularly, the connecting plate 318 is connectable to the distal and proximal vertical members 102, 108 of the outer stanchion 96 at one of infinitely variable positions substantially along the vertical lengths of the distal and proximal vertical members 102, 108. Likewise, the connecting plate 320 is connectable to the distal and proximal vertical members 122, 126 of the inner stanchion 100 at one of infinitely variable positions substantially along the vertical lengths of the distal and proximal vertical members 122, 126. As a result, the vertical position of the tray 316 is infinitely variable by raising or lowering the tray subassembly 312 to a selected location along the vertical length of the outer stanchion 96 and the inner stanchion 100. The tray subassembly 312 also includes a pair of gliders 322, 324 connecting the tray 316 to the connecting plates 318, 320, respectively. The gliders 322, 324 allow the tray 316 to move between a retracted position, in which the tray 316 is housed completely or substantially within the raceway core 14, and an extended position, in which the tray 316 projects outwardly from the raceway core 14 so as to facilitate access to equipment carried thereon by a user and/or a service technician.

Referring to FIGS. 3 and 4, the remaining tray subassemblies 308, 310, 314 are identical to the tray subassembly 312 in construction, operation and function. The tray subassembly 308 is mounted directly to the inner stanchion 52 and the outer stanchion 48 of the stanchion subassembly 44, while the tray subassembly 310 is mounted directly to the inner stanchion 52 and the outer stanchion 50. Likewise, the tray subassembly 314 is mounted directly to the inner stanchion 100 and the outer stanchion 98 of the stanchion subassembly 46.

Referring back to FIGS. 1 and 2, the desk system 10 is provided with an end panel 326 which is mounted to the frame assembly 12 in a conventional manner, closing off the otherwise open raceway 16 of the raceway core 14. More particularly, the end panel 326 is removably connected to the free ends 80, 136 of the header members 74, 130, respectively, and the free ends 84, 140 of the sill members 76, 132, respectively.

As shown in FIGS. 1, 2 and 4, the desk system 10 is also provided with work tops 328, 330 which are substantially identical to the work tops disclosed in applicant's above-mentioned applications. More particularly, the work tops 328, 330 extend outwardly from the sides 18, 20, respectively, of the raceway core 14. The work top 328 has an end, which is removably secured to the ledge 212 of the support arm 210 of the support subassembly 200, and an opposite end removably secured to the end panel 326 by a bracket (not shown). The work top 328 is spaced from the side 18 of the raceway core 14 so as to form an equipment bay 332 between the side 18 and the work top 328. The work top 328 includes a support stringer cleat 334 depending therefrom and a Z-shaped hook (not shown) attached to the stringer cleat 334 for supporting equipment bay accessories, such as work top extensions 336 and telecommunication turrets (not shown), in the equipment bay 332 in a manner similar to that disclosed in applicant's above-mentioned applications.

The work top 330 has an end, which is removably secured to the ledge 224 of the support arm 222 of the support subassembly 202, and an opposite end removably secured to the end panel 326 by a bracket (not shown). The work top 330 is spaced from the side 20 of the raceway core 14 so as to form an equipment bay 338 between the side 20 and the work top 330. The work top 330 includes a support stringer cleat 340 depending therefrom and a Z-shaped hook (not shown) attached to the stringer cleat 340 for supporting equipment bay accessories, such as work top extensions 342 and telecommunication turrets (not shown), in the equipment bay 338 in a manner similar to that disclosed in applicant's above-mentioned applications.

Figure 8:
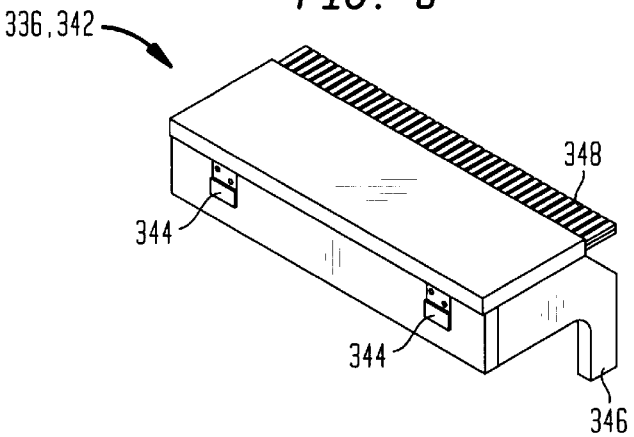
FIG. 8 is a perspective view of a work top extension utilized in the desk system shown in FIGS. 1 and 2.

With reference to FIGS. 2 and 8, the work top extensions 336, 342 are supported in the equipment bays 332, 338, respectively, from the work tops 328, 330, respectively, in a cantilevered fashion. More particularly, each of the work top extension 336, 342 has Z-shaped hooks or clips 344 which mate with a corresponding one of the Z-shaped hooks of the work tops 328, 330. Each of the work top extensions 336, 342 has feet 346 resting on a corresponding one of the headers 74, 130. A continuous brush grommet 348 is provided on each of the work top extensions 336, 342 to allow the passage of electrical supply lines or the like therethrough.

The desk system 10 also includes a plurality of levelers 350 (see FIG. 2) depending from the stanchions 48, 50, 52, 96, 98, 100, the support subassemblies 200, 202 and the end panel 326. The levelers 350 cooperate with each other to permit leveling of the desk system 10.

Figure 10:
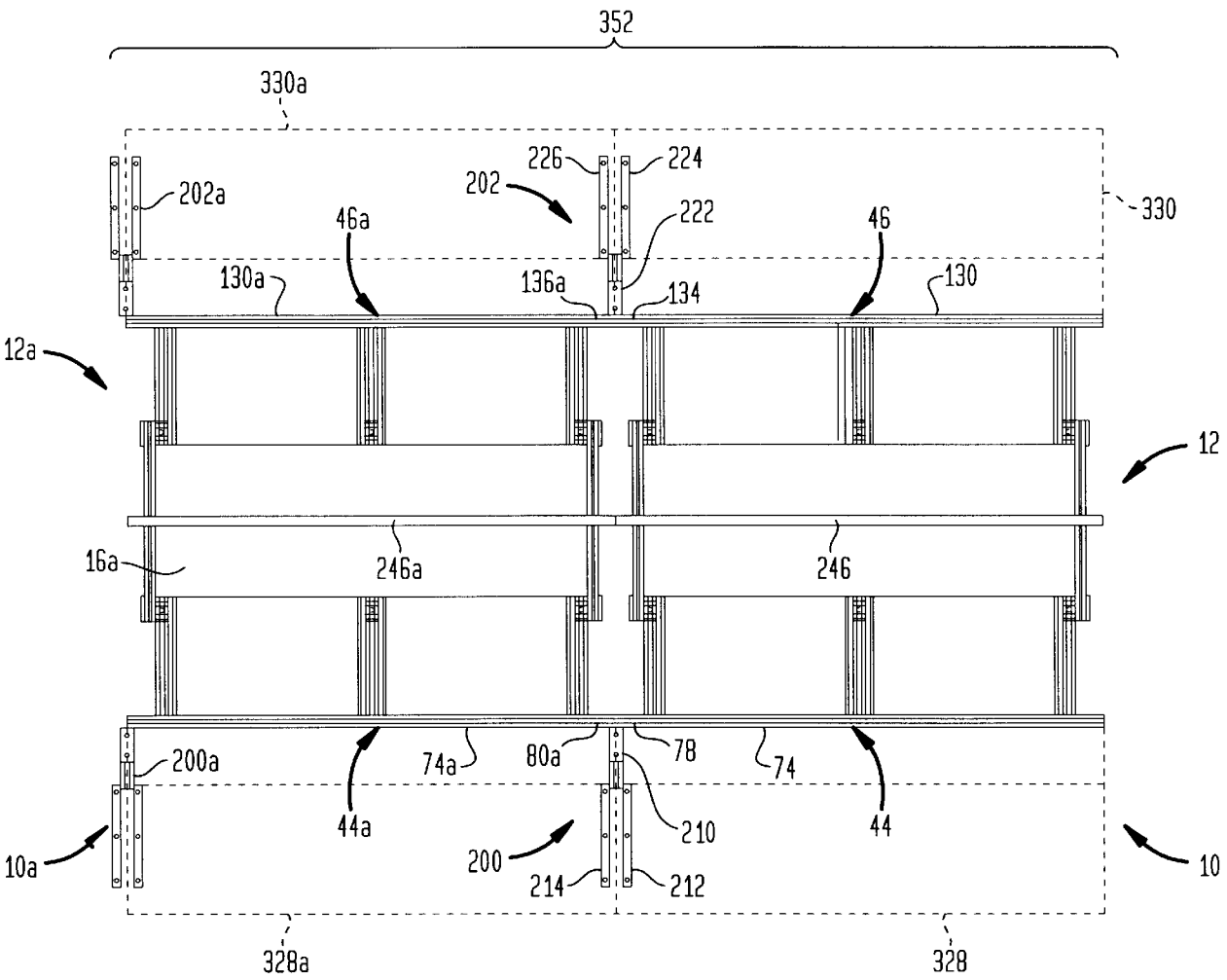
FIG. 10 is a top plan view of a cluster of desk systems formed by the desk system shown in FIGS. 1–4 and another desk system which are arranged in an end-to-end fashion.

In use, the desk system 10 is adapted to be utilized in combination with other identical or similar desk systems to form a variety of different cluster configurations. For instance, as shown in FIG. 10, the desk system 10 can be connected to a desk system 10*a*, which is substantially identical to the desk system 10 in construction and operation, and cooperates with same in forming a cluster of side-by-side desk systems 352. To facilitate consideration and discussion, components of the desk system 10*a*, which correspond, either identically or substantially, to the components of the desk system 10, have been designated by corresponding reference numerals followed by "a".

Referring to FIG. 10, the frame assembly 12 of the desk system 10 is attached to a frame assembly 12*a* of the desk system 10*a* in an end-to-end fashion. That is, the stanchion subassemblies 44, 46 of the desk system 10 is removably connected to stanchion subassemblies 44*a*, 46*a*, respectively, of the desk system 10*a*. Accordingly, the free ends 78, 130 of the header members 74, 13, respectively, are attached to free ends 80*a*, 136*a*, respectively, of header members 74*a*, 130*a*, respectively, of the desk system 10*a*. Likewise, the free ends 82, 138 of the sill members 76, 132, respectively, are attached to adjacent free ends (not shown) of the sill members (not shown) of stanchion subassemblies 44*a*, 46*a*. In this manner, the frame assemblies 12, 12*a* of the desk systems 10, 10*a*, respectively, form a continuous frame structure extending from one end of the cluster 352 to an opposite end of same.

Still referring to FIG. 10, because the support subassembly 200 outwardly overhang the free ends 78, 82 of the header and sill members 74, 76, respectively, of the stanchion subassembly 44, the support subassembly 200 is also secured to the free end 80*a* of the header member 74*a* and the free end of the sill member of the stanchion subassembly 44*a*. Similarly, because the support subassembly 202 outwardly overhang the free ends 134, 138 of the header and sill members 130, 132, respectively, of the stanchion subassembly 46, the support subassembly 202 is also secured to the free end 136*a* of the header member 130*a* and the free end of the sill member of the stanchion subassembly 46*a*. In this manner, the support subassemblies 200, 202 are adapted to support not only the work tops 328, 330, respectively, of the desk system 10 but also work tops 328*a*, 330*a* of the desk system 10*a*. As a result, the work top 328*a* of the desk system 10*a* is supported on the ledge 214 of the support arm 210 of the support subassembly 200 at one end thereof, while the work top 330*a* is supported on the ledge 226 of the support arm 222 of the support subassembly 202 at one end thereof.

As shown in FIG. 10, the slat wall panel 246 is adjoined with a slat wall panel 246*a* of the desk system 10*a*. More particularly, the slat wall panels 246, 246*a* of the desk systems 10, 10*a*, respectively, cooperate to form a continuous slat wall structure extending between the ends of the cluster 352 without disruption. As a result, the continuous slat wall structure is adapted to support slat wall accessories, such as the tiltable platforms 272, 274, 276, 280, 282, 284, therefrom at any position along the length of the slat wall structure (i.e., between the ends of the cluster of desk systems). For instance, slat wall accessories can be supported over a seam formed between the desk systems 10, 10*a*.

Still referring to FIG. 10, because the desk system 10 is provided with an end panel, it constitutes an end desk unit of the cluster of desk systems 352. On the other hand, the desk system 10*a* is provided with a pair of C-shaped support subassemblies 200*a*, 202*a*, and therefore constitutes an inner unit of the cluster of desk systems 352 That is, another desk system (not shown) is attached to the desk system 10*a* in a manner similar to the one described above in connection with the desk systems 10, 10*a*. Alternatively, if it is desired to make the desk system 10*a* into the other end unit of the cluster of desk systems 352, the support subassemblies 200*a*, 202*a* are removed from the desk system 10*a*. An end panel 326*a* is then attached to the desk system 10*a* so as to close off an otherwise open raceway 16*a* of the desk system 10*a*.

It should be appreciated that the present invention provides numerous advantages over the prior art discussed above. For instance, the desk system 10 facilitates efficient field installation, as well as quick and easy adjustability and retrofittability. That is, the desk system 10 is adapted to be readily modified to suit the following variables: the changing work environment in the trading room which houses the desk system 10; the particular ergonomic preferences of the user; and changes in equipment size, shape and configuration. For this purpose, the raceway 16 of the desk system 10 is compartmentalized into separate and independent equipment bays or compartments by the outer and inner stanchions 48, 50, 52 of the stanchion subassembly 44 and the outer and inner stanchions 96, 98, 100 of the stanchion subassembly 46, thereby allowing the raceway 16 to be utilized in an efficient manner. More particularly, because the equipment bays 86, 88, 142, 144 are adapted to be used separately and independently from one another, each of the tray subassemblies 308, 310, 312, 314 can be selectively and independently removed from a corresponding one of the equipment bays 86, 88, 142, 144 to accommodate, for instance, oversized data and communication equipment (e.g., a large CPU tower for a computer) without disturbing or disrupting the other equipment bays. In this regard, the movable sections 94, 148 of the sill members 76, 132, respectively, facilitate placement or removal of oversized equipment from the equipment bays 88, 144, respectively. That is, because the movable sections 94, 148 is pivotable to their open positions, they increase clearance for oversized equipment. In addition, oversized equipment can be placed into or removed from the equipment bay 88 or the equipment bay 144 by sliding same on the floor 74.

To accommodate the variable mentioned above, the sizes of the equipment bays 86, 88, 142, 144 can be easily changed by moving the inner stanchions 52, 100 towards or away from the outer stanchions 48, 96, respectively, or the outer stanchions 50, 98, respectively. Moreover, each of the inner stanchions 52, 100 is selectively and independently removable from the raceway 16 along with its associated tray subassemblies for the purpose of integrating its corresponding equipment bays. In other words, by removing the inner stanchions 52, 100 from the raceway 16, continuous equipment bays are formed in the raceway extending between the outer stanchions 48, 50 and between the outer stanchions 96, 98. In such circumstances, each of such continuous equipment bays may receive a tray subassembly spanning between a corresponding pair of the outer stanchions 48, 50 and the outer stanchions 96, 98 or other types of rack subassemblies, such as those disclosed in applicant's above-mentioned applications.

It should also be appreciated that the size of the raceway 16 can be easily changed to accommodate changing work environment, user preferences, etc. For instance, the depth of the raceway 16 (i.e., the distance between the sides 18, 20 of the raceway core 14) can be easily adjusted. More particularly, due to its extruded construction, the distal vertical member 54 of the outer stanchion 48 is attached to the lower and upper strut members 150, 154 in such a manner that distal vertical member 54 is attachable at any one of a plurality of infinitely variable positions along the lengths the lower and upper strut members 150, 154. Likewise, the distal vertical member 66 of the outer stanchion 50 is attached to the lower and upper member 152, 156 in such a manner that the distal vertical member 66 is attachable at any one of a plurality of infinitely variable positions along the lengths of the lower and upper members 152, 156. Accordingly, by securing the distal vertical members 54, 66 to different locations along the lower and upper strut members 150, 154 and along the lower and upper strut members 152, 156, respectively, the depth of the raceway 16 can be modified in a desired manner. For example, in order to decrease the depth of the raceway 16, the distal vertical members 54, 66 and hence their corresponding stanchions (i.e., the stanchions 48, 50) are first loosened from the lower and upper strut members 150, 154 and from the lower and upper strut members 152, 156, respectively, and are then secured to locations along same which are closer to the side 20 of the raceway core 14. The stanchion 96, 98 are also movable towards or away from the side 18 of the raceway core 14 in a manner similar to the one described above.

The desk system 10 also facilitates servicing and maintenance. For instance, because the work tops 328, 330 are easily removable from the frame assembly 12, which remains upright and stable, a repairman or a technician may gain easy and quick access to the raceway 16, as well as to the computer monitor and to any other equipment which may be mounted on the platforms 272, 274, 276 or on the platforms 280, 282, 284. In this regard, the support subassemblies 200, 202 and/or their corresponding header and sill members can also be removed from the frame assembly 12 together with the work tops 328, 330, respectively. Moreover, the size of the raceway 16 and its unobstructed nature facilitate accessibility by technicians responsible for servicing the equipment housed in the raceway 16.

It should also be appreciated that the desk system 10 facilitates assembly and disassembly. More particularly, the desk system 10 has a number of structures that are common to both of the workstations defined by the work tops 328, 330. As a result, the desk system 10 requires a reduced number of parts and is thereby adapted for easy and efficient assembly and disassembly. For instance, the desk system 10 has the raceway core 14 and the slat wall panel 246 removably suspended substantially above the raceway 16 in such a manner that the raceway 16 is substantially unobstructed. Because the raceway core 14 and the slat wall panel 246 are common to their associated back-to-back work stations defined by the work tops 328, 330, they function to eliminate structural components which would be required in a desk system formed by arranging a pair of single work station desks in a back-to-back manner. Owing to the elimination of such structural components, the desk system 10 requires less space and less time for assembly and disassembly.

The desk system 10 also has supporting structures which are shared by an adjacent desk system, such as the desk system 10*a* shown in FIG. 10. For instance, the support subassembly 200 supports both of the work tops 328, 328*a* of the desk systems 10, 10*a*, respectively, while the support subassembly 202 supports both of the work tops 330, 330*a*. These common support structures further reduce the space requirements and manufacturing and/or assembly costs associated with the construction of a cluster of desk systems.

The manner in which the desk system 10 is connected to an adjacent desk provides additional advantages. With reference to FIG. 10, the frame assemblies 12, 12*a* of the desk systems 10, 10*a*, respectively, forms a continuous frame structure. As a result, the raceway cores 14, 14*a* of the desk systems 10, 10*a* form a substantially continuous raceway extending from one end of the frame structure to an opposite end of same, thereby allowing each of the raceway cores 14, 14*a* to be utilized for housing data and communication equipment or the like not only for its corresponding desk system but also for its adjacent desk system or systems. In addition, because the header and sill members 74, 76 of the stanchion subassembly 44 of the desk system 10 and the header and sill members 130, 132 of the stanchion subassembly 46 of same are connected to their counterparts of the desk system 10*a* in an end-to-end fashion without disruption, a continuous header and sill structures is formed extending between the cluster of desk systems 352. Such header and sill structures cooperate with their associated rails in allowing doors to slide from one desk system to another desk system.

It should be noted that the present invention can have many variations and modifications. For instance, the extrusion members of the frame assembly 12 of the desk system 10 can have different sizes and shapes. The support subassemblies 200, 202 can also be located at positions other than those shown in FIGS. 1–4. Moreover, additional support subassemblies can be provided to further support the work tops 328, 330. The end panel 326 can be replaced with other components, such support structures similar to the support subassemblies 200, 202. The equipment bays 332, 338 of the desk system can also receive accessories other than the work top extensions 336, 342, respectively, such as telecommunication turrets similar to those disclosed in applicant's above-mentioned applications. Moreover, the desk system 10 can be constructed as a single workstation desk system. Because the platforms 272, 274, 276, 280, 282, 284 are readily removable, each of them can also be replaced by another type of platform or component. In addition, while the slat wall panel 246 is substantially suspended above the floor 178, it can be supported directly from the floor 178 when it is desired to enhance its support capacity. Further, the slat wall panel 246 may be replaced by any other conventional means for supporting its associated platforms and/or components in a cantilevered fashion. Regardless of the cantilevering means employed, the platforms 272, 274, 276, 280, 282, 284 are suspended directly above the substantially open (i.e., uncovered) top of the raceway core 14.

It will be understood that the embodiment described herein is merely exemplary and that a person skilled in the art may make many further variations and modifications without departing from the spirit and scope of the invention. All such variations and modifications are intended to be included within the scope of the invention as defined in the appended claims.

I claim:

1. A frame-type desk system, comprising a common core which has a longitudinal axis and which includes an interior raceway extending longitudinally from one end of said core to an opposite end of said core; at least one work top extending outwardly from one side of said core so as to define at least one work station; a supporting panel mounted on said core and having a side which includes mounting means for mounting a plurality of accessories therefrom in a cantilevered fashion substantially above said raceway, said side of said supporting panel facing said at least one work station such that accessories mounted therefrom extend towards said at least one work station; a plurality of stanchions, each of which extends into said raceway from said one side of said core, each adjacent pair of stanchions defining an equipment bay which is located in said raceway between said one end and said opposite end of said core and which extends longitudinally along said one side of said core, said equipment bay being sized and shaped so as to receive electronic equipment therein, said plurality of stanchions being spaced from said supporting panel in a direction substantially transverse to said longitudinal axis of said core such that a channel is formed in said raceway between said plurality of stanchions and said supporting panel, whereby electrical or communication cables can be fed through said channel to electronic equipment housed in said equipment bay or supported from said supporting panel; and at least one horizontal strut member extending substantially transverse to said longitudinal axis from one of said stanchions, wherein said supporting panel is attached to said at least one horizontal strut member.

2. The desk system of claim 1, wherein said plurality of stanchions includes a first stanchion and a second stanchion, said first and second stanchions being arranged along said one side of said core and cooperating with each other so as to define a first equipment bay therebetween, each of said first and second stanchions including at least one extrusion member.

3. The desk system of claim 2, further comprising first supporting means for supporting electronic equipment in said first equipment bay, said first supporting means being mounted directly to said at least one extrusion member of said first stanchion and to said at least one extrusion member of said second stanchion in such a manner that said first supporting means is positionable at one of a plurality of positions along the vertical lengths of said first and second stanchions.

4. The desk system of claim 3, wherein said first supporting means is mounted to said first and second stanchions above a bottom of said core such that said first supporting means is suspended above a floor supporting said core.

5. The desk system of claim 4, wherein said at least one extrusion member of said first stanchion and said at least one extrusion member of said second stanchion are vertically oriented; and wherein said first supporting means includes a first tray assembly directly mounted to said at least one extrusion member of said first stanchion and to said at least one extrusion member of said second stanchion in such a manner that said first tray assembly is positionable at one of an infinite number of positions along the vertical lengths of said at least one extrusion member of said first stanchion and said at least one extrusion member of said second stanchion.

6. The desk system of claim 5, wherein each of said first and second stanchions includes another vertically oriented extrusion member, said first tray assembly mounted directly to said another extrusion member of said first stanchion and to said another extrusion member of said second stanchion.

7. The desk system of claim 6, wherein said at least one extrusion member of said first stanchion and said at least one extrusion member of said second stanchion are arranged along said one side of said core; and wherein said another extrusion member of said first stanchion and said another extrusion member of said second stanchion are arranged adjacent an inner side of said first equipment bay between said one side of said core and said supporting panel.

8. The desk system of claim 7, wherein said core includes a header member, which extends continuously from said one end of said core to said opposite end of said core along said one side of said core and which is attached to an upper end of said at least one extrusion member of said first stanchion and to an upper end of said at least one extrusion member of said second stanchion, and a sill member, which extends continuously from said one end of said core to said opposite end of said core along said one side of said core and which is attached to a lower end of said at least one extrusion member of said first stanchion and to a lower end of said at least one extrusion member of said second stanchion, each of said header member and said sill member having an extruded construction.

9. The desk system of claim 8, wherein said sill member includes a stationary portion and a movable portion which is pivotally connected to said stationary portion, said movable portion being movable between a closed position, which it is aligned with said stationary portion and with said one side of said core, and an open position, in which it is pivoted outwardly from said one side of said core, said movable portion being aligned with said first equipment bay and being positionable in its said open position to facilitate the placement of oversized electronic equipment in said first equipment bay or the removal of oversized electronic equipment from said first equipment bay.

10. The desk system of claim 9, wherein said first stanchion includes a pair of horizontal extrusion members, one of which extends between said upper end of said at least one extrusion member of said first stanchion and an upper end of said another extrusion member of said first stanchion, and the other of which extends between said lower end of said at least one extrusion member of said first stanchion and a lower end of said another extrusion member of said first stanchion; and wherein said second stanchion includes a pair of horizontal extrusion members, one of which extends between said upper end of said at least one extrusion member of said second stanchion and an upper end of said another extrusion member of said second stanchion, and the other of which extends between said lower end of said at least one extrusion member of said second stanchion and a lower end of said another extrusion member of said second stanchion.

11. The desk system of claim 4, wherein said first supporting means is detachable from said first and second stanchions such that it is removable from said first equipment bay.

12. The desk system of claim 11, wherein said first supporting means includes a tray mounted between said first stanchion and said second stanchion, said tray being movable between a retracted position, in which said tray is housed substantially within said first equipment bay and therefore within said raceway, and an extended position, in which said tray projects outwardly from said first equipment bay so as to facilitate access to electronic equipment carried thereon.

13. The desk system of claim 3, wherein said plurality of stanchions includes a third stanchion having at least one extrusion member, said second and third stanchions cooperating with each other so as to form a second equipment bay therebetween.

14. The desk system of claim 13, further comprising second supporting means for supporting electronic equipment in said second equipment bay, said second supporting means being mounted directly to said at least one extrusion member of said second stanchion and to said at least one extrusion member of said third stanchion in such a manner that said second supporting means is positionable at one of a plurality of positions along the vertical lengths of said second and third stanchions, said second stanchion constituting a supporting structure common to said first supporting means and to said second supporting means.

15. The desk system of claim 14, wherein said first, second and third stanchions are positioned along said one side of said core, said first stanchion being positioned adjacent said one end of said core, said third stanchion being positioned adjacent said opposite end of said core, and said second stanchion being positioned between said first and third stanchions, whereby said first and second equipment bays are arranged in a side-by-side manner along said one side of said core.

16. The desk system of claim 15, wherein said at least one extrusion member of said first stanchion and said at least one extrusion member of said second stanchion are vertically oriented; wherein said first supporting means includes a first tray assembly mounted directly to said at least one extrusion member of said first stanchion and to said at least one extrusion member of said second stanchion such that said first tray assembly is positionable at one of an infinite number of positions along the vertical lengths of said at least one extrusion member of said first stanchion and said at least one extrusion member of said second stanchion; wherein said at least one extrusion member of said third stanchion is vertically oriented; and wherein said second supporting means includes a second tray assembly mounted directly to said at least one extrusion member of said second stanchion and to said at least one extrusion member of said third stanchion in such a manner that said second tray assembly is positionable at one of an infinite number of positions along the vertical lengths of said at least one extrusion member of said second stanchion and said at least one extrusion member of said third stanchion.

17. The desk system of claim 16, wherein each of said first and second stanchions includes another vertically oriented extrusion member; wherein said first tray assembly is mounted directly to said another extrusion member of said first stanchion and to said another extrusion member of said second stanchion; wherein said third stanchion includes another vertically oriented extrusion member; and wherein said second tray assembly is mounted directly to said another extrusion member of said second stanchion and to said another extrusion member of said third stanchion.

18. The desk system of claim 15, wherein said core includes a header member, which extends continuously from said one end of said core to said opposite end of said core along said one side of said core, a sill member, which extends continuously from said one end of said core to said opposite end of said core along said one side of said core, said header member and said sill member being attached to said first, second and third stanchions, each of said header member and said sill member having an extruded construction.

19. The desk system of claim 2, wherein said at least one horizontal strut member includes a first strut member, which extend along one end of said core between said one side of said core and an opposite side of said core, and a second strut member, which extends along said opposite end of said core between said one side of said core and said opposite side of said core.

20. The desk system of claim 19, wherein said first stanchion is attached to said first strut member at one of a plurality of positions along the length of said first strut member; and wherein said second stanchion is attached to said second strut member at one of a plurality of positions along the length of said second strut member.

21. The desk system of claim 20, further comprising another work top extending outwardly from said opposite side of said core so as to define another work station opposite said at least one work station.

22. The desk system of claim 21, further comprising a plurality of opposing stanchions, each of which extends into said raceway from said opposite side of said core, each adjacent pair of opposing stanchions defining an equipment bay which is located in said raceway between said one end and said opposite end of said core, which extends longitudinally along said opposite side of said core, and which is sized and shaped so as to receive electronic equipment therein.

23. The desk system of claim 22, wherein said plurality of opposing stanchions are spaced from said supporting panel in a direction substantially transverse to said longitudinal axis of said core such that said channel is formed in said raceway between said plurality of stanchions and said plurality of opposing stanchions.

24. The desk system of claim 23, wherein said plurality of opposing stanchions includes a third stanchion adjacent said one end of said core and a fourth stanchion adjacent said opposite end of said core, said first and second strut members being attached to said third and fourth stanchions, respectively.

25. The desk system of claim 24, wherein said third stanchion is attached to said first strut member at one of a plurality of positions along the length of said first strut member; and wherein said fourth stanchion is attached to said second strut member at one of a plurality of positions along the length of said second strut member.

26. The desk system of claim 19, further comprising a plurality of opposing stanchions, each of which extends into said raceway from said opposite side of said core, each adjacent pair of opposing stanchions defining an equipment bay which is located in said raceway between said one end and said opposite end of said core, which extends longitudinally along said opposite side of said core, and which is sized and shaped so as to receive electronic equipment therein, and said plurality of opposing stanchions being spaced from said supporting panel in a direction substantially transverse to said longitudinal axis of said core such that said channel extends in said raceway between said plurality of stanchions and said plurality of opposing stanchions.

27. The desk system of claim 26, wherein said first and second strut members are mounted to said core above a bottom of said core such that said first and second strut members are suspended above a floor supporting said core so as to accommodate floor-mounted or floor-supported equipment.

28. The desk system of claim 27, wherein said at least one horizontal strut member includes a third strut member, which extends along said one end of said core between said one side of said core and said opposite side of said core, a fourth strut member, which extends along said opposite end of said core between said one side of said core and said opposite side of said core.

29. The desk system of claim 28, wherein said third and fourth strut members are positioned adjacent an open top of said core above said first and second strut members, respectively, such that said third and fourth strut members are suspended above a floor supporting said core.

30. The desk system of claim 29, wherein said supporting panel includes a lower section extending into an upper portion of said raceway channel, said lower section of said supporting panel having one end, which is supported on said first strut member and secured to an end of said third strut member, and an opposite end, which is supported on said second strut member and secured to an end of said fourth strut member.

31. The desk system of claim 30, further comprising a fifth strut member, which extends along said one end of said core from said opposite side of said core towards said one side of said core, and a sixth strut member, which extends along said opposite end of said core from said opposite side of said core towards said one side of said core, said first strut member being attached to said first stanchion and to one of said plurality of opposing stanchions, and said second strut member being attached to said second stanchion and to another of said plurality of opposing stanchions.

32. The desk system of claim 31, wherein said third and fifth strut members abut one another in a spaced fashion so as to form a first gap therebetween, said first gap receiving said one end of said lower section of said supporting panel; and wherein said fourth and fifth strut members abut one another in a spaced fashion so as to form a second gap therebetween, said second gap receiving an opposite end of said lower section of said supporting panel, said lower section of said supporting panel being secured to said fifth and sixth strut members.

33. The desk system of claim 1, further comprising another work top extending outwardly from an opposite side of said core so as to define another work station, said supporting panel being positioned between said at least one work station and said another work station, said supporting panel having an opposite side which includes another mounting means for mounting a plurality of accessories therefrom in a cantilevered fashion substantially above said raceway and which faces said another work station such that accessories mounted therefrom extend towards said another work station, said supporting panel constituting a support structure common to said at least one work station and said another work station.

34. The desk system of claim 33, further comprising a plurality of opposing stanchions, each of which extends into said raceway from said opposite side of said core, each adjacent pair of opposing stanchions defining an equipment bay which is located in said raceway between said one end and said opposite end of said core, which extends longitudinally along said opposite side of said core, and which is sized and shaped so as to receive electronic equipment therein, said plurality of opposing stanchions being spaced from said supporting panel in a direction substantially transverse to said longitudinal axis of said core such that said channel extends in said raceway between said plurality of stanchions and said plurality of opposing stanchions, said plurality of stanchions including a first stanchion and a second stanchion, said plurality of opposing stanchions including a third stanchion and a fourth stanchion, said first and second stanchions cooperating with each other so as to define a first equipment bay therebetween, and said third and fourth stanchions cooperating with each other so as to define a second equipment bay therebetween, and each of said first, second, third and fourth stanchions including at least one extrusion member.

35. The desk system of claim 34, further comprising first supporting means for supporting electronic equipment in said first equipment bay and second supporting means for supporting electronic equipment in said second equipment bay.

36. The desk system of claim 35, wherein said at least one extrusion member of said first stanchion and said at least one extrusion member of said second stanchion are vertically oriented and are arranged along said one side of said core; and wherein said at least one extrusion member of said third stanchion and said at least one extrusion member of said fourth stanchion are vertically oriented and are arranged along said opposite side of said core.

37. The desk system of claim 36, wherein said first supporting means includes a first tray assembly mounted directly to said at least one extrusion member of said first stanchion and to said at least one extrusion member of said second stanchion in such a manner that said first tray assembly is positionable at one of a plurality of positions along the vertical lengths of said first and second stanchions; and wherein said second supporting means includes a second tray assembly mounted directly to said at least one extrusion member of said third stanchion and to said at least one extrusion member of said fourth stanchion in such a manner that said second tray assembly is positionable at one of a plurality of positions along the vertical lengths of said third and fourth stanchions.

38. The desk system of claim 37, wherein said plurality of stanchions includes a fifth stanchion having at least one extrusion member, said second and fifth stanchions cooperating with each other so as to define a third equipment bay therebetween; and wherein said plurality of opposing stanchions includes a sixth stanchion having at least one extrusion member, said fourth and sixth stanchions cooperating with one another so as to define a fourth equipment bay therebetween.

39. The desk system of claim 38, further comprising third supporting means for supporting electronic equipment in said third equipment bay and fourth supporting means for supporting electronic equipment in said fourth equipment bag, said second stanchion constituting a supporting structure common to said first supporting means and said third supporting means, and said fourth stanchion constituting a supporting structure common to said third supporting means and said fourth supporting means.

40. The desk system of claim 39, wherein said at least one extrusion member of said fifth stanchion and said at least one extrusion member of said sixth stanchion are vertically oriented.

41. The desk system of Claim 40, wherein said third supporting means includes a third tray assembly mounted directly to said at least one extrusion member of said second stanchion and to said at least one extrusion member of said fifth stanchion in such a manner that said third tray assembly is positionable at one of a plurality of positions along the vertical lengths of said second and fifth stanchions; and wherein said fourth supporting means includes a fourth tray assembly mounted directly to said at least one extrusion member of said fourth stanchion and to said at least one extrusion member of said sixth stanchion in such a manner that said fourth tray assembly is positionable at one of a plurality of positions along the vertical lengths of said fourth and sixth stanchions.

42. The desk system of claim 1, wherein said plurality of stanchions has a first stanchion, which is located adjacent said one end of said core, and a second stanchion, which is located adjacent said opposite end of said; and wherein said at least one horizontal strut member includes a first horizontal strut, which extends in a direction substantially transverse to said longitudinal axis of said core and which is positioned adjacent said one end of said core, and a second horizontal strut, which extends in a direction substantially transverse to said longitudinal axis of said core and which is positioned adjacent said opposite end of said core, said first strut extending between said supporting panel and said first stanchion for interconnecting said first stanchion to said supporting panel in a spaced manner, and said second strut extending between said supporting panel and said second stanchion for interconnecting said second stanchion to said supporting panel in a spaced manner.

43. The desk system of claim 42, wherein said first and second stanchions include inner sides positioned in said raceway between said supporting panel and said one side of said core, said inner sides of said first and second stanchions being attached to said first and second struts, respectively.

44. The desk system of claim 42, wherein each of said inner sides of said first and second stanchions is removably attached to a corresponding one of said first and second struts at one of an infinite number of positions along the length of a corresponding one of said first and second struts, whereby the transverse depth of said channel is infinitely variable to accommodate changing work environment or user preference.

45. The desk system of claim 1, further comprising a plurality of opposing stanchions, each of which extends into said raceway from said opposite side of said core, each adjacent pair of opposing stanchions defining an equipment bay which is located in said raceway between said one end and said opposite end of said core, which extends longitudinally along said opposite side of said core, and which is sized and shaped so as to receive electronic equipment therein, said plurality of opposing stanchions being spaced from said supporting panel in a direction substantially transverse to said longitudinal axis of said core such that said channel extends in said raceway between said plurality of stanchions and said plurality of opposing stanchions, whereby said channel is common to all of said equipment bays.

* * * * *

UNITED STATES PATENT AND TRADEMARK OFFICE

CERTIFICATE OF CORRECTION

PATENT NO. : 6,050,659
DATED : April 18, 2000
INVENTOR(S) : Paul M. LaCour

It is certified that error appears in the above-identified patent and that said Letters Patent is hereby corrected as shown below:

Column 7,
Line 67, after "FIG.", insert -- "5" --.

Signed and Sealed this

Fourteenth Day of October, 2003

JAMES E. ROGAN
*Director of the United States Patent and Trademark Office*